US005954008A

United States Patent [19]

Je Cho

[11] Patent Number: 5,954,008

[45] Date of Patent: Sep. 21, 1999

[54] LARGE DECK VESSEL WITH MULTI-LEGS

[76] Inventor: William Woon Je Cho, 2286 Kingston Rd., Scarborough, Ontario, Canada, MIN 1T9

[21] Appl. No.: 08/863,276

[22] Filed: May 27, 1997

[51] Int. Cl.[6] ..... B63B 1/00

[52] U.S. Cl. ..... 114/61.14; 114/265

[58] Field of Search ..... 114/61, 265, 261, 114/264, 61.12–61.4

[56] References Cited

U.S. PATENT DOCUMENTS

| | | | |
|---|---|---|---|
| 1,892,125 | 12/1932 | Armstrong | 114/265 |
| 2,405,115 | 8/1946 | Creed | 114/61 |
| 3,279,407 | 10/1966 | Stenger | 114/61 |
| 3,430,595 | 3/1969 | Tulleners | 114/61 |
| 4,437,794 | 3/1984 | Grimsley et al. | 114/265 |
| 4,440,103 | 4/1984 | Lang | 114/61 |
| 5,433,161 | 7/1995 | Loui | 114/61.14 |

FOREIGN PATENT DOCUMENTS

| | | | |
|---|---|---|---|
| 55-94874 | 7/1980 | Japan | 114/61 |
| 7-100466 | 11/1992 | Japan . | |
| 2135949 | 9/1984 | United Kingdom | 114/61 |

*Primary Examiner*—Ed Swinehart

*Attorney, Agent, or Firm*—Armstrong, Westerman, Hattori, McLeland &Naughton

[57] ABSTRACT

An upper body, forming a large deck which is always above water, and a submerged body, which is always submerged in the water, are disposed in the up-and-down direction with a certain distance therebetween. The upper body and submerged body are connected by a plurality of connecting legs. An outer peripheral portion of the upper body is formed to have a stream-lined configuration symmetric in the up-and-down direction. A middle portion of the upper body is formed to have upper and lower surfaces parallel with one another, except for the outer peripheral portion thereof. The connecting leg may include either a single hollow body or a double hollow body. The submerged body is formed to be approximately a T-shaped in vertical cross-section and has a permanent ballast fixed at bottom and side surfaces of the inside portion thereof. A permanent ballast may also be filled in a lateral connecting body which connects adjacent submerged bodies. A thruster is installed for the purpose of keeping the correct posture of the vessel and for controlling the vessel. The thruster is automatically operated by a computer having a specially designed computer program. One of the divided upper bodies or one part of the divided upper body may ascend and descend for the purpose of trafficking of cargo, passengers and crew.

15 Claims, 3 Drawing Sheets

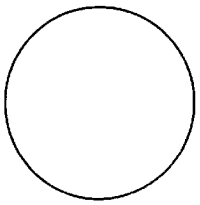
FIG. 4A
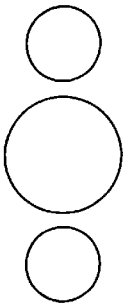
FIG. 4B
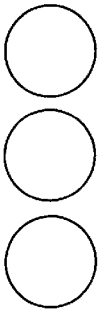
FIG. 4C
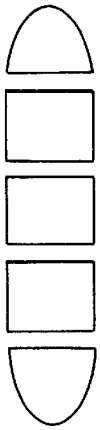
FIG. 4D
FIG. 4E
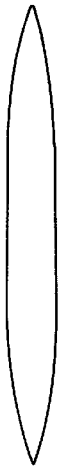
FIG. 4F
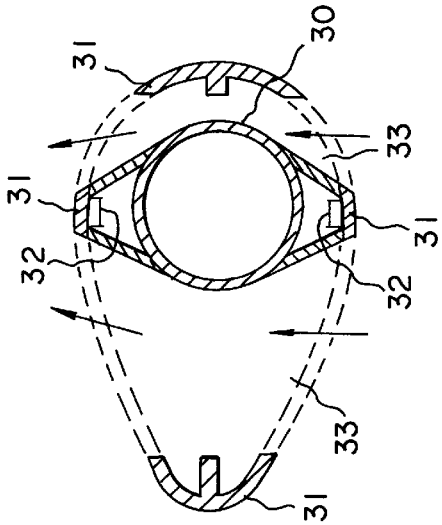
FIG. 6
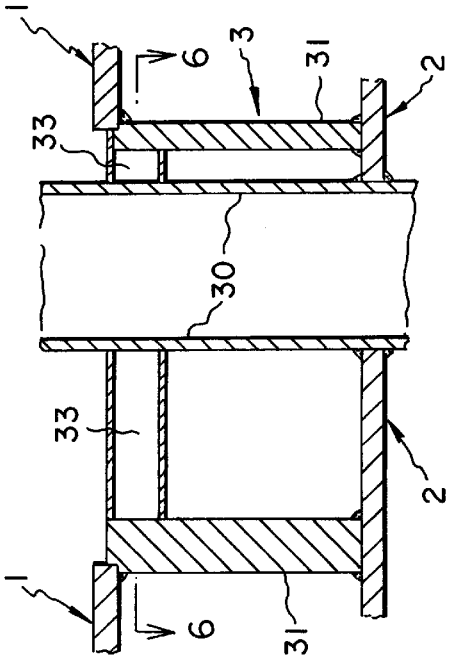
FIG. 5

LARGE DECK VESSEL WITH MULTI-LEGS

FIELD OF THE INVENTION

The present invention relates to a large deck vessel with multi-legs and more particularly, to a large deck vessel with multi-legs which includes an upper body forming a large deck which is always above water, a submerged body which is always submerged under water and a plurality of legs which connect the upper body and the submerged body. The large deck vessel with multi-legs can be utilized as a transport ship having a large transportation capacity, a moving airport, a sea farming mother ship or similar.

BACKGROUND OF THE INVENTION

Conventionally, this kind of large deck vessel with multi-legs has been known by a Japanese examined patent publication No. TOKUKQHEI 7-100466, which was invented by the inventor of the present invention.

In the large deck vessel with multi-legs, the vessel is intended to have such a large deck that the width or length of the deck is from tens of meters to thousands of meters or more. As for the purpose of the vessel, the vessel is intended for use not only as a transport ship having a large transportation capacity in place of a conventional giant tanker, but also as a solar energy ship, a moving airport, or a sea farming mother ship using the large deck. Furthermore, making use of the characteristic that the submerged body is kept cool by the surrounding water which is at almost a constant temperature throughout the year, any one of an economical special refrigerated ship, a chemical transport ship, or an LNG long-distance transport ship can also be an intended use of the vessel.

The large deck vessel with multi-legs has a special structure, made up of an upper body which is always above water, a submerged body which is always submerged under water and disposed under the upper body, and a plurality of legs which connect the upper body and the submerged body. The large deck vessel with multi-legs has various kinds of special characteristics different from a conventional ship because of the special structure of the large deck vessel according to the present invention.

For instance, the upper body is influenced by the heat caused by sunlight and by the wind in a different level or manner in comparison to a conventional ship, because the upper body forming a deck in the large deck vessel of the present invention is always positioned above water. In the case of the large deck vessel having an upper body which forms an especially large deck, since the influence of wind to the upper body is significant, the larger the deck, i.e., the upper body, the larger the power needed for lifting, lowering, or inclining the upper body becomes. Furthermore, the larger the surface area of the deck exposed to sunlight or cold wind, the larger the influence caused by thermal expansion or contraction of the upper body becomes.

Although the submerged body is always under water and therefore is not influenced by the wind, the submerged body is heavily influenced by the resistance of water when the vessel begins to incline or restore itself to its original posture. For example, in the case of a conventional ship, sea waves affect large changes in the buoyancy of the whole ship because they directly act against the ship. In the case of the large deck vessel with multi-legs, however, sea waves affect only the connecting legs because the upper body is completely above water and the submerged body is always under water. Further, the total volume of the legs is very small compared to the total volume of the submerged bodies, and the different phases of the sea waves encountering the connecting legs will be set off by one another because of the dispersedly disposed connecting legs. As a result, changes in the buoyancy of the whole vessel due to the sea waves are considerably smaller than the changes in buoyancy of a conventional ship.

Furthermore, the large deck vessel with multi-legs has the special characteristic that a longer time is needed to restore the vessel from an inclined state to an upright state than the restoring time needed for a conventional ship. In other words, when the vessel is inclining, a vertical downward gravity of the vessel at the center of gravity of the ship, a vertical upward buoyancy of the vessel at the center of the buoyancy of the vessel, and a resistance power for displacing water by the submerged bodies brought about from when the vessel starts inclining until it stops inclining, will act as righting moments. However, there is the drawback that a longer restoring time is needed because the resistance power also acts as an anti-righting moment when the vessel starts restoring from the inclined state toward the upright state since the resistance power acts in a direction opposite to the restoring direction.

As mentioned above, in the large deck vessel with multi-legs, the vessel has a special constitution different from a conventional ship. The vessel is heavily influenced by the wind because it has an upper body constituting a large deck. The vessel should be designed with thermal influence caused by the sunshine and cold wind taken into consideration. Furthermore, the upper body, constituting a large deck, is required to maintain a correct posture at all times in spite of the changing position of the center of gravity due to loading, unloading or moving a cargo or similar.

SUMMARY OF THE INVENTION

The present invention is in consideration of the special characteristics of the large deck vessel with multi-legs. One of the objects of the present invention is to provide a large deck vessel with multi-legs which can easily keep the correct posture of the vessel by minimizing the influence of the wind.

Another object of the present invention is to provide a large deck vessel with multi-legs which can be put to practical use despite the expansion and contraction of the upper body caused by the sunlight and cold wind.

Still another object of the present invention is to provide a large deck vessel with multi-legs which can maintain the correct posture at all times, in spite of the movement of the center of gravity when loading and unloading cargo, or the influences of forces due to the wind.

According to the present invention, a large deck vessel with multi-legs includes an upper body forming a large deck which is always above water, a submerged body which is always submerged under water and a plurality of connecting legs which connect the upper body and the submerged body. The deck has an outer peripheral portion with a stream-lined configuration which is symmetric in the up-and-down direction thereof. The deck has upper and lower surfaces at its middle portion, except for the outer peripheral portion. The surfaces are formed to be parallel with one another.

The above-mentioned configuration of the upper body can reduce not only the air resistance blown from the side or created by the running of the vessel, but also can minimize the lifting, descending or inclining force of the upper body in the case of storm conditions.

The upper body may be formed to be approximately round in configuration, when observed from the top so as to keep a stable posture, regardless of the wind direction.

The larger the upper body, the more the wind and/or thermal effects will influence the upper body. Therefore, in this case, instead of a single approximately round configuration, the upper body preferably comprises a plurality of unit upper bodies connected in series, wherein each unit upper body is formed to be approximately round in configuration as observed from the top.

With respect to the concrete configuration of the upper body, the configuration is not limited to being approximately round, and may be, for example, the configuration of an approximately round circle which has been elongated (i.e., oblong, oval or race-track shaped) as observed from the top. In this case, the upper body may comprise a plurality of divided upper bodies connected to one another with a certain space therebetween and shaped so as to be configured as a whole into an approximately round circle that has been elongated in consideration of the influences of wind and/or heat.

With respect to the connecting legs connecting the upper body and the submerged body, the connecting leg may be formed as a hollow body vertically arranged between the upper body and the submerged body so that a conjunction passage can be formed therebetween. The connecting leg may comprise a hollow body arranged in an inclined state between the upper body and the submerged body. The hollow body may be a single hollow body or it may be a double hollow body, not only to improve the strength of the body, but also to divide the inside space for uses such as for installing an elevator or for installing emergency stairs or piping, etc.

With respect to the connecting leg, a horizontally penetrated vent passage may be provided at an above-water portion of the upper body to reduce air resistance against lateral wind.

With respect to the submerged body, it is preferable that the submerged body is formed to be approximately T-shaped in vertical cross-section so as to raise the center of buoyancy of the vessel by creating large buoyancy on an upper portion of the submerged body.

The submerged body may have a permanent ballast filling room having a certain length at both sides of a lower part of the submerged body so as to lower the center of gravity of the vessel.

For the purpose of lowering the center of gravity of the vessel, it is preferable to provide a lateral connecting body which connects adjacent submerged bodies. The lateral connecting body is filled by permanent ballasts at an inner lower part of the connecting body, and is also formed to be filled by another permanent ballast therein.

For the purpose of keeping the correct posture of the vessel, it is preferable that a number of thrusters are installed in the submerged body to act as a reaction force against the submerged body by sucking in nearby water and jetting out pressurized water.

With respect to the thruster, it is desirable that the thruster automatically adjusts its jetting force and jetting direction by using of a computer with a program for analyzing the external force against the vessel, for analyzing the requisite force for keeping the correct posture of the vessel, and for controlling the vessel or similar.

It is desirable that the upper body has an inside space therein to load, store, or move freights, automobiles, or similar. For the purpose of carrying freights out from the inside space of the upper body to the deck, or carrying freights in from the deck to the inside space of the upper body, the upper body is divided into a plurality of divided upper bodies, and at least one of the divided upper bodies is allowed to rise and fall between an upper-most position and an lower-most position to form a moveable divided upper body. An upper surface of the movable divided upper body reaches an upper surface of an adjacent divided upper body at the upper-most position and an upper surface of the movable divided upper body reaches a floor surface of the inside space of the adjacent divided upper body at the lower-most position.

Other objects and advantages of the present invention will become apparent from the attached drawings and the following detailed description of the preferred embodiment.

BRIEF DESCRIPTION OF THE DRAWING FIGURES

FIG. 4 shows plan views of a second embodiment of an upper body, wherein

FIG. 4A is a plan view showing a single upper body having a round configuration as observed from its top, FIG. 4B is a plan view of an upper body comprising a larger round central upper body and smaller round upper bodies located at the front and rear of the central upper body and connected thereto, FIG. 4C is a plan view of an upper body comprising three same-size upper bodies each having a round configuration as observed from its top and connected in series, FIG. 4D is a plan view of an upper body having a configuration of an approximately round circle which has been elongated, FIG. 4E is a plan view of an upper body having a configuration of an approximately round circle which has been elongated and divided into a plurality of divided portions in the direction of its length, and FIG. 4F is a side view of the upper body shown in FIG. 4D.

FIG. 5 is a cross-sectional view of the connecting leg.

FIG. 6 is a cross-sectional view taken along the lines 6—6 in FIG. 5.

Figure 7:
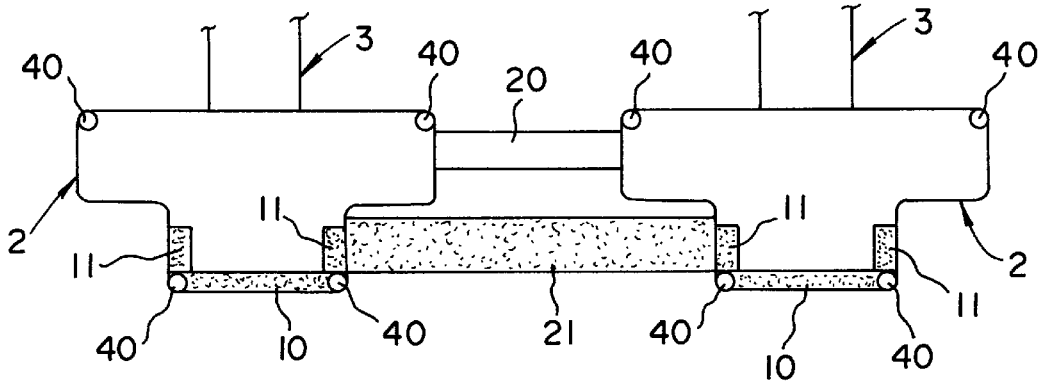

FIG. 7 is an illustration showing the arrangement of the permanent fixed ballast.

Figure 8:
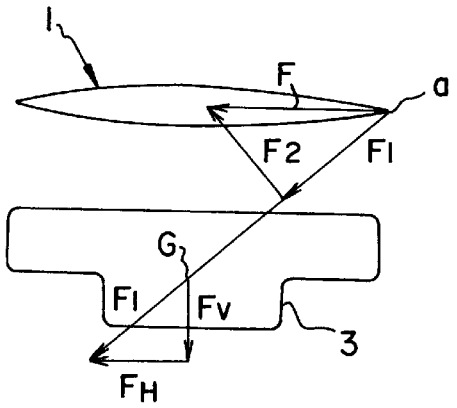

FIG. 8 is an illustration which explains the effect of transverse wind on the vessel at the center of gravity of the vessel.

Figure 9:
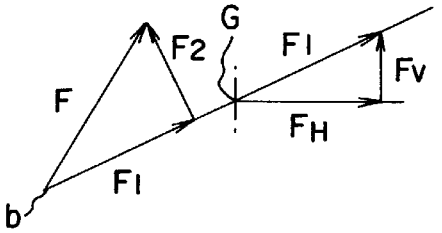

FIG. 9 is an illustration which explains how the reaction of the thruster works.

DETAILED DESCRIPTION OF THE PREFERRED EMBODIMENT

The preferred embodiments of the present invention will now be described in detail with reference to the accompanying drawings.

In each embodiment, the deck is supposed to have thousands of meters in width and/or length. However, the present invention is not limited to a vessel having a deck of the above-mentioned size, but includes a vessel having a deck of from tens of meters to hundreds of meters in width and/or length.

Figure 1:
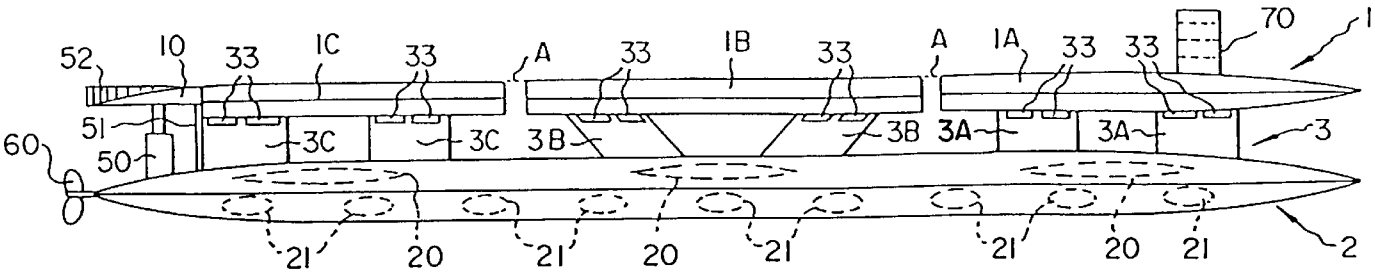
FIG. 1 is a side view of a first embodiment of the large deck vessel with multi-legs according to the present invention.

The embodiment shown in FIG. 1 has an upper body 1 which constitutes a large deck, a pair of right and left submerged bodies 2 arranged under the upper body 1 at a certain interval and a plurality of connecting legs 3, each connecting the upper body 1 and the submerged body 2.

Figure 3:
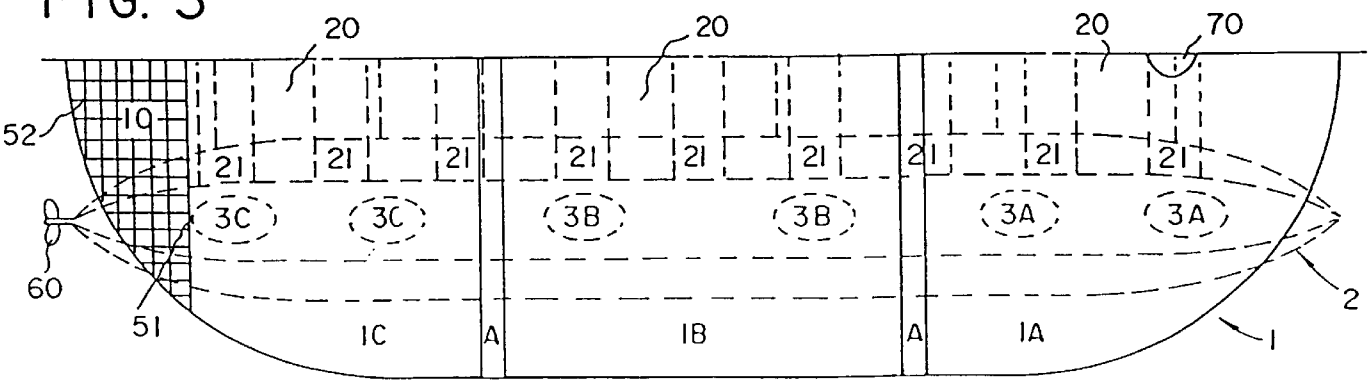
FIG. 3 is a half-breadth plan view of the large deck vessel with multi-legs shown in FIG. 1.

As shown in FIG. 3, the upper body 1 is formed to be of a configuration that is approximately round, but elongated, as observed from a top of the upper body 1. The upper surface of the upper body 1 constitutes a deck and the inside thereof constitutes cargo and crew space.

The upper body 1 comprises three divided upper bodies 1A, 1B, 1C connected to one another along the length of the upper body 1 with a certain space. The upper body 1C has a divisional portion 1D for cargo loading and unloading.

Because the upper body 1 is exposed to the sunshine and cold wind, the influence of expansion or contraction of the upper body 1 caused by thermal changes thereof cannot be neglected. The larger the surface area of the upper body 1 constituting the deck, the larger the influences become. Thus, as mentioned above, the upper body 1 is divided in the direction of its length so as to minimize the thermal influences causing expansion or contraction. Although adjacent divided upper bodies 1A, 1B, 1C are connected with a certain space therebetween, a bridging plate A is slidably disposed between adjacent divided upper bodies 1A and 1B, and 1B and 1C to cover the space so that a continuous deck can absorb the expansion and contraction of each divided upper body 1A, 1B, 1C due to thermal influences.

With respect to a countermeasure for the expansion or contraction of the upper body 1, it is not limited only to the above-described embodiment where the upper body 1 is divided into a plurality of divided upper bodies 1A, 1B, 1C in the direction of its length and connected to one another to have a configuration as a whole, when observed from a top thereof, of an approximately round circle which has been elongated. In addition, the upper body 1 may comprise a plurality of unit upper bodies connected to one another in series in order to have a configuration, when observed from a top thereof, of an approximately round circle which has been elongated, as shown in FIG. 4B and 4C.

Figure 2:
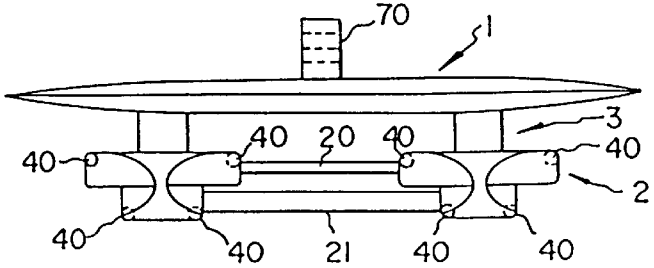
FIG. 2 is a front view of the large deck vessel with multi-legs shown in FIG. 1.

The above-described upper body 1 constituting a large deck should be designed to minimize the influence of wind because the upper body 1 is always disposed above water so as to be susceptible to the wind. To decrease the wind effect in the first embodiment, the outer peripheral portion is formed to be of a stream-lined configuration which is symmetric in an up-and-down direction, and upper and lower surfaces of a middle portion are formed parallel with each other as shown in FIGS. 1 and 2, except for the outer peripheral portion thereof. This configuration of the upper body 1 can minimize any lifting, lowering or inclining force even if the wind blows from the side of the upper body 1. Further, the above-mentioned divided upper body 1A, 1B, 1C can also minimize air resistance, especially any air resistance that is blown from the side.

The concrete shape of the upper body 1 should be decided upon by taking into consideration the merits of the configuration of the upper body, the climate such as temperature and wind condition of the servicing area, the kind of cargo to be loaded, the size of the deck, the purpose of the vessel and similar.

As shown in FIGS. 2 and 3, the submerged body 2 comprises a pair of right and left submerged bodies and each of the left and right submerged bodies are disposed below a lateral end portion of the upper body 1 and along the length thereof. The submerged body 2 has a hollow inner space for producing the buoyancy of the vessel. The space also constitutes cargo and crew space as in the upper body 1.

Each submerged body 2 is connected to the upper body 1 via a plurality of connecting legs 3.

The divided upper body 1A, constituting a bow deck of the upper body 1, and the divided upper body 1C, constituting a stern deck of the upper body 1, are connected to each submerged body 2 by a pair of vertically arranged fore-and-aft connecting legs 3A, 3A, 3C, 3C, as shown in FIG. 1. The intermediate divided upper body 1B is connected to the submerged body 2 by a pair of fore-and-aft connecting legs 3B, 3B, which are inclined frontwardly and rearwardly at a certain angle, respectively.

The submerged body 2 is formed, as shown in FIGS. 1 and 3, in a stream-lined form at a fore part and an aft part thereof to reduce the water resistance. The submerged body 2 is formed in an approximately T-shaped configuration in a transverse cross-section thereof, as shown FIGS. 2 and 7. In other words, the upper portion is wide and the lower portion is narrow. The reason why such a configuration is employed is to raise the position of the center of buoyancy of the vessel by making the buoyancy large at the upper portion of the submerged body.

As shown in FIG. 7, a fixed permanent ballast 10 of high specific gravity is provided at the inside bottom portion of the lower part of the submerged body 2, as well as fixed permanent ballasts which are provided at inside side portions of the lower part of the submerged body 2. These ballasts are effective for lowering the position of the center of gravity of the vessel.

Adjacent submerged bodies 2, 2 are connected, at upper portions thereof, to each other by means of three upper connecting bodies 20 which are disposed at a certain interval in the direction of the submerged body 2. A cross-section of each upper connecting bodies 20 is formed in a stream-lined shape at the fore-and-aft portions, as shown in FIG. 1, to reduce the water resistance. Adjacent submerged bodies 2, 2 are connected, at lower portions thereof, to each other by nine lower connecting bodies 21 which are disposed at a certain interval in the direction of the submerged body 2. A cross-section of each lower connecting body 21 is formed in an elliptical shape, as shown in FIG. 1, to reduce the water resistance similar to the upper connecting body 20.

The upper connecting body 20 constitutes a passage for cargo and crew between both right and left submerged bodies 2.

The lower connecting body 21 is filled with permanent ballast for lowering the position of the center of gravity of the vessel.

The connecting leg 3 is connected, at the upper end thereof, to the upper body 1 and is connected, at the lower end thereof, to the submerged body 2. The inside of the upper body 1 communicates with the inside of the submerged body 2 via the connecting legs 3 so that the connecting legs 3 can be used to carry the cargo from the upper body 1 to the submerged body 2 and vice versa via the connecting legs 3 and can also be used as passages for the crew.

The connecting legs 3 may be single bodies (see FIG. 3). The connecting legs 3 as shown in FIGS. 5 and 6, are preferably double hollow bodies comprising an inner body 30 and an outer body 31. In the inner body 30 an elevator (not shown) is provided for the passage of cargo and crew. In a space between the outer body 31 and the inner body 30, an emergency stairs 32 is provided, and the space can be used as a piping space for many kinds of pipe lines, etc.

As shown in FIGS. 1, 5 and 6, the connecting leg 3 has, at an upper part thereof (i.e., a part always above water), a transversely penetrated vent passage 33. This minimizes air resistance to the transverse wind and also minimizes air stream disturbance causing, under the upper body 1, the reduction of the lifting and descending force of the vessel.

Especially in the case of the large deck vessel with multi-legs, it is important to keep the correct posture of the vessel whenever the vessel is either stopped or running, and also whenever the vessel is in either calm water or in stormy water. To keep the correct posture of the vessel, it is necessary to set off the outer force which creates an inclination of the vessel, especially the outer force acting on the upper body 1 when in the height of a storm, and the movement of the center of gravity of the vessel when loading, unloading or moving cargo. As for the loading or unloading of cargo from the vessel, it is possible to keep the correct posture of the vessel by performing the loading or the unloading with consideration of the movement of the center of gravity. However, as for the keeping the correct posture when at the height of a storm, it is not easy to keep the correct posture of the vessel, especially in the case where the height of the storm includes sudden horizontal winds, in which case it is necessary to take measures to meet the situation. Therefore, it is necessary to analyze the situation to take steps to cope with the situation.

The influence of the maximum transverse wind force affecting the center of gravity of the vessel will be analyzed as follows based on FIG. 8. The maximum transverse wind force F (F denotes vector) acting to the acting point a can be divided into $F_1$, and $F_2$, i.e., $F=F_1+F_2$. $F_1$ can be divided into $F_v$ and $F_H$, i.e., $F_1=F_v+F_H$. Thus, F will be divided into $F_v$, $F_H$ and $F_2$, wherein $F_v$, $F_H$ and the turning moment of $F_2 \times G_a$ (the distance from the center of gravity G to the acting point a) act to the center of gravity G of the vessel. This leads to the conclusion that the transverse force, which acts on the upper body 1, moves the vessel in either the up-and-down direction or the left-and-right direction and gives the turning moment at the center of gravity G of the vessel.

As for the restoring force, it is difficult to create a sufficient distance between the center of gravity G and the center of buoyancy B in the case of the large deck vessel with multi-legs. Furthermore, a long restoring time is required because the resistance power also works as an anti-righting moment. As a result, means for correcting posture of the vessel are preferably required.

In this large deck vessel with multi-legs of this embodiment, a plurality of thrusters 40 are provided to each submerged body 2. The thruster 40 sucks in nearby water and jets out the pressurized water to give a reaction force against the submerged body 2.

As shown in FIG. 7, the thrusters 40 are provided along the length of the submerged body 2 with a certain distance at each of the two upper and two lower corners of the submerged body 2.

The thruster 40 is for generating a part of the righting force of the vessel by automatically controlling the reaction force on the submerged body 2 and the acting direction by using a computer. Therefore, the jetting power and the jetting direction of the thruster 40 can be adjusted automatically by a computer with a program which analyzes the acting force from the outside to the vessel, the righting force to keep the correct posture of the vessel and the necessary managing power of the vessel, etc. Furthermore, the thruster 40 may be directly propeller connected to an electrical, hydraulic or pneumatic motor, or a turbine which sucks in and jets out water. The magnitude of the thruster 40 should be adjustable with respect to its reactions to the submerged body 2 and movable in the direction of action.

The reaction of the thruster will be explained based on FIG. 9 as follows.

The jet reaction force F at the point b is $F=F_1+F_2$, wherein $F_1$ can be divided into $F_H$ and $F_v$, i.e., $F_1=F_H+F_v$. $F_H$ and $F_v$ act as a horizontal moving force and a vertical moving force at the center of the gravity G, respectively. $F_2$ gives turning moment $F_2 \times G_b$) (the distance between the center of the gravity G and the point b) around the center of gravity G. The reaction of the thruster 40 moves the vessel in either the up-and-down direction or the left-and-right direction and gives the turning moment at the center of gravity G of the vessel. Therefore, the above-mentioned moving force in either the up-and-down direction or the left-and-right direction and the turning moment at the center of gravity G of the vessel will be set off by the reaction of the thruster 40, thus enabling the vessel to keep the correct posture. The thruster 40 is effectively used to manage the vessel as well.

In the large deck vessel with multi-legs, in order to enhance the utility of the vessel, it is important to have some device which facilitates easy and rapid movement of cargo from another vessel to the upper body 1, then moves the cargo into the inside of the upper body 1 and, then through the connecting legs 3 to the submerged body 2 and vice versa. So in the first embodiment as shown in FIG. 1, the divided upper body 1C, located at the stern portion, is further divided into the movable divided upper body 1D. The stern divided upper body 1D is raised and lowered by an elevating apparatus 50 between an upper most position and an lower most position such that an upper surface of the stern divided upper body 1D reaches an upper surface of the adjacent divided upper body 1C at the upper most position and an upper surface of the stern divided upper body 1D reaches a floor surface of the inside space of the adjacent divided upper body 1C at the lower most position. The cargo loaded on the cargo saddle 52 of the stern divided upper body 1D travels down to the lower point together with the divided upper body 1D and is moved into the inside of the adjacent divided upper body 1C. The cargo is moved out from the inside of the upper body 1 to the outside of the upper body 1 in the reverse manner. The elevating guide 51 is to confine the up-and-down movements and the left-and-right movements of the stern divided upper body 1D.

Although in the first embodiment, the movable divided upper body 1D is settled at the stern portion, it can be settled at any part of the deck, such as at the middle part of the deck, the fore part of the deck, and the side part of the deck.

In FIG. 1, the reference numeral 60 denotes a propulsive propeller and the reference numeral 70 denotes a managing tower.

The large deck vessel with multi-legs, according to the present invention, can be used as a solar energy ship, a moving airport making use of the large deck, a transport ship having a large transportation capacity in place of a conventional giant tanker, a sea farming mother ship making use of the vessel's largeness. Furthermore, the large deck vessel with multi-legs can be used as an economical special refrigerated ship, a chemical transport ship, or a LNG long-distance transport ship, each making use of the characteristic that the submerged body is kept cool by the surrounding water, which is at almost a constant surrounding temperature throughout the year.

The terms and explanations which have been employed herein are used as terms of description and not of limitation, and there is no intent, in the use of such terms and expressions, of excluding any equivalents of the features shown and described or portions thereof, but it should be recognized that various modifications are possible within the spirit and scope of the invention claimed.

What is claimed is:

1. A large deck vessel with multi-legs, comprising:

an upper body forming a large deck, wherein said upper body is above water at all times;

a submerged body, wherein said submerged body is always submerged under water and is formed to be approximately T-shaped in a vertical cross-section so as to raise a center of buoyancy of said vessel by creating a large buoyancy on an upper portion of said submerged body; and a plurality of connecting legs, spaced apart from each other, connecting said upper body with said submerged body.

2. The large deck vessel with multi-legs as recited in claim 1, wherein said connecting leg comprises a hollow body arranged vertically between said upper body and said submerged body.

3. The large deck vessel with multi-legs as recited in claim 2, wherein said connecting leg comprises a single hollow body.

4. The large deck vessel with multi-legs as recited in claim 1, wherein said connecting leg comprises a double hollow body.

5. The large deck vessel with multi-legs as recited in claim 1, wherein said connecting leg is provided with a transversely penetrated vent passage at an upper part of said connecting leg.

6. The large deck vessel with multi-legs as recited in claim 1, wherein said submerged body has a permanent ballast filling room having a certain length at both sides of a lower part of said submerged body so as to lower a center of gravity of said vessel.

7. The large deck vessel with multi-legs as recited in claim 1, wherein said submerged body has a permanent ballast fixed at a bottom inside portion of said submerged body so as to lower a center of gravity of said vessel.

8. The large deck vessel with multi-legs as recited in claim 1, further comprising a plurality of thrusters installed to said submerged body, wherein said thruster sucks in nearby water and jets out pressurized water so as to act as a reaction against said submerged body.

9. The large deck vessel with multi-legs as recited in claim 1, wherein said upper body comprises a plurality of divided upper bodies, and at least one of said divided upper bodies is allowed to any one of ascend and descend between an upper-most position and a lower-most position to form a movable divided upper body such that an upper surface of said movable divided upper body reaches to an upper surface of an adjacent divided upper body at said upper-most position and said upper surface of said movable divided upper body reaches to a floor surface of said inside space of said adjacent divided upper body at said lower-most position.

10. The large deck vessel with multi-legs, as recited in claim 1, wherein said thrusters are provided along the length of the submerged body with a certain distance at each of two upper and two lower corners of the submerged body.

11. The large deck vessel with multi-legs comprising:

an upper body forming a large deck, said upper body being above water at all times and including a plurality of upper body units connected in series, and each upper body unit is formed to have an approximately round configuration as observed from a top thereof;

a submerged body always being submerged under water; and a plurality of connecting legs, spaced apart from each other, connecting said upper body with said submerged body.

12. The large deck vessel with multi-legs comprising:

an upper body forming a large deck, said upper body being above water at all times and being formed to have a configuration which is an approximately round circle that has been elongated as observed from a top thereof;

a submerged body always being submerged under water; and a plurality of connecting legs, spaced apart from each other, connecting said upper body with said submerged body.

13. The large deck vessel with multi-legs comprising:

an upper body forming a large deck, said upper body being above water at all times and including a plurality of divided upper bodies connected to each other so as to have a predetermined space therebetween, and said upper body has a configuration as a whole of an approximately round circle that has been elongated as observed from a top thereof;

a submerged body always being submerged under water; and a plurality of connecting legs, spaced apart from each other, connecting said upper body with said submerged body.

14. A large deck vessel with multi-legs, comprising:

an upper body having at least first and second upper body units forming a large deck, wherein said upper body is above water at all times;

a submerged body, wherein said submerged body is always submerged under water; and a plurality of connecting legs having a hollow body, spaced apart from each other, straight upright ones of said plurality of connecting legs connecting said first upper body unit with said submerged body and inclined ones of said plurality of connecting legs connecting said second upper body unit with said submerged body.

15. The large deck vessel with multi-legs as recited in claim 14, wherein each of said connecting legs comprises a single hollow body.

* * * * *